US010322354B2

(12) United States Patent
Machado Gamero

(10) Patent No.: US 10,322,354 B2
(45) Date of Patent: Jun. 18, 2019

(54) ANGULARLY ADJUSTABLE BALANCING DEVICE

(71) Applicant: Luis Gerardo Machado Gamero, Goose Creek, SC (US)

(72) Inventor: Luis Gerardo Machado Gamero, Goose Creek, SC (US)

( * ) Notice: Subject to any disclaimer, the term of this patent is extended or adjusted under 35 U.S.C. 154(b) by 0 days.

(21) Appl. No.: 15/655,142

(22) Filed: Jul. 20, 2017

(65) Prior Publication Data

US 2018/0221783 A1 Aug. 9, 2018

Related U.S. Application Data

(60) Provisional application No. 62/456,265, filed on Feb. 8, 2017.

(51) Int. Cl.

| | |
|---|---|
| ***A63F 9/26*** | (2006.01) |
| ***A63H 15/04*** | (2006.01) |
| ***A63H 33/00*** | (2006.01) |
| ***A63H 33/26*** | (2006.01) |
| ***A63H 1/00*** | (2019.01) |
| ***A63F 9/34*** | (2006.01) |
| ***A63F 9/00*** | (2006.01) |
| ***A63F 11/00*** | (2006.01) |
| ***A63F 3/00*** | (2006.01) |

(52) U.S. Cl.

CPC ..... *A63H 33/26* (2013.01); *A63F 3/00895* (2013.01); *A63F 9/00* (2013.01); *A63F 9/26* (2013.01); *A63F 9/34* (2013.01); *A63F 11/0011* (2013.01); *A63H 1/00* (2013.01); *A63H 15/04* (2013.01); *A63H 33/00* (2013.01); *A63F 2009/0013* (2013.01); *A63F 2011/0016* (2013.01); *A63F 2250/024* (2013.01)

(58) Field of Classification Search

CPC ..... A63H 33/00; A63H 33/26; A63H 15/00; A63H 15/04; A63F 9/34; A63F 9/26

See application file for complete search history.

(56) References Cited

U.S. PATENT DOCUMENTS

| | | | | | |
|---|---|---|---|---|---|
| 1,766,282 | A * | 6/1930 | Colbert | A63H 11/04 | 446/326 |
| 1,996,600 | A * | 4/1935 | Vass | A63H 13/00 | 119/900 |
| 2,281,656 | A * | 5/1942 | Abernethy | A63H 33/00 | 446/326 |
| 2,431,138 | A * | 11/1947 | Ressinger | A47D 13/105 | 472/112 |

(Continued)

*Primary Examiner* — Eugene L Kim
*Assistant Examiner* — Alyssa M Hylinski
(74) *Attorney, Agent, or Firm* — Southeast IP Group, LLC.; Thomas L. Moses; Randy J. Tucker

(57) ABSTRACT

A balancing device which includes a plate which can be affixed to an object to be balanced, a balance member to be removably affixed to the plate, a support, and both the balance member and support having each one of a pointed spike and concave depression which receives the pointed spike. A user affixes the plate to an object to be balanced and attaches the balance member to the plate. Thereafter, a user places the object on top of the support resting on a surface so that the pointed spike is inserted into the concave depression. The object balances upon the support at an angle which can be adjusted by moving where the balance member is attached on the metal plate.

20 Claims, 5 Drawing Sheets

(56) References Cited

U.S. PATENT DOCUMENTS

| | | | | | |
|---|---|---|---|---|---|
| 3,375,604 | A * | 4/1968 | Alonso | A63H 3/16 | 446/92 |
| 3,417,506 | A | 12/1968 | Howell | | |
| 3,818,630 | A * | 6/1974 | May | A63H 33/40 | 446/396 |
| 4,057,247 | A | 11/1977 | Morrison | | |
| 4,182,470 | A * | 1/1980 | Atkinson | A45F 5/00 | 224/183 |
| 4,212,131 | A * | 7/1980 | Ross, Jr. | A63H 33/18 | 446/46 |
| 4,358,110 | A * | 11/1982 | Youkstetter | A63F 9/26 | 273/450 |
| 5,163,647 | A * | 11/1992 | Fader | A63H 27/00 | 248/123.11 |
| 5,932,303 | A | 8/1999 | Stern | | |
| 6,168,492 | B1 * | 1/2001 | Glassberg | A63H 15/04 | 446/325 |
| 6,511,360 | B1 * | 1/2003 | Lyman | A63H 13/18 | 40/485 |
| 6,612,895 | B2 | 9/2003 | Sze | | |
| 6,773,328 | B2 | 8/2004 | Tiefel et al. | | |
| 7,220,184 | B1 * | 5/2007 | Akers | A63G 11/00 | 472/106 |
| 2010/0022158 | A1 * | 1/2010 | Kim | A63H 33/046 | 446/92 |

* cited by examiner

ANGULARLY ADJUSTABLE BALANCING DEVICE

CROSS-REFERENCE TO RELATED APPLICATION

This application claims the benefit of U.S. Provisional Application No. 62/456,265, entitled ADJUSTABLE PIVOT POINT ASSEMBLY, filed on Feb. 8, 2017 which is hereby incorporated by reference in its entirety.

BACKGROUND OF THE INVENTION

This invention relates to balancing devices of the type which affix at or near an object's center of gravity and which naturally return an object to a balanced angular equilibrium determined by where on the object the device is affixed, in relation to the center of gravity. In particular, the present invention relates to balancing devices capable of achieving a desired angular orientation of an object without rotating such device or adding, moving, or adjusting a counterweight and which can still allow the object to freely rotate about a point.

The ability to balance items about a point, like a tip is known to and particularly useful amongst toys, games, tops, and other novelty devices. However, many such devices commonly require rotation at a particular speed to be balanced on a tip, thereby not allowing balancing of a stationary item. Even if they do allow balancing of a stationary item, such devices commonly require engagement of the tip in a way that limits the motion of the device, such as not allowing the device to be freely spun about a point. Further, even if such devices do not require rotation to balance and allow the free motion of the device, it is uncommon for such devices to allow variation of the angle at which the device is balanced by any other means that adjustment, changing, or combining or counterweights. Lastly, no matter how such devices are balanced, many such devices commonly do not also allow a user to choose various objects to be supported. The following references serve as examples of such devices and are hereby incorporated herein by reference.

U.S. Pat. No. 3,417,506

An articulated body composed of a lower hollow portion adapted to be balanced on a support, and an upper portion movably connected to the lower portion and carrying an arcuate balancing rod of substantial length and curvature which has a weight affixed to each of its ends. An electric motor is located within the hollow portion of the body and is adapted to move the upper portion of the body relative to the lower portion. Dry cell batteries are used for the weights and electrical conductor means extending through the arcuate rod electrically connect the batteries with the electric motor.

U.S. Pat. No. 4,458,782

An instructional balancing toy set for use, for instance, by preschool children to amuse and entertain the children while at the same time conveying concepts of object size and object weight. The device includes a base and a plurality of vertically stackable balancing members. The base is upwardly converging and frusto-conical in shape and rests on a support surface, and has a circular top lip which receives a generally spherical intermediate second balancing member to hold the spherical member in a predetermined upright proper orientation. The spherical member when properly oriented, includes an upwardly projecting lug at the top thereof which is received in a lug receiver on the bottom of a figurine to support the figurine in upright position on top of the spherical member as a third member of the assembly. The figurine member includes a generally concave depression on the top surface thereof.

Additional vertically stackable balancing members are intended to be stacked in a certain order and have decreasing size and weight characteristics progressively from the bottom of the stack to the top. Each member, in the form of a figurine or portion of a figurine, has a bottom pointed projection for forming a fulcrum when supported in a top depression of another member. Each also has opposing outwardly and downwardly projecting arms terminating in weights of sufficient mass, the weights being sufficiently below the respective bottom pointed projection so that when the balancing member is placed with the tapered point received in the concave depression at the top of the lower balancing member, a fulcrum effect and stable balancing equilibrium can be achieved.

The device can be constructed in a special form in which the balancing members are intended to be vertically oriented in a particular seriatim order. In such form, the balancing member weights are of a proper mass and at a proper distance below the balancing point or fulcrum so as to be insufficient to provide stable equilibrium for a stack in which a heavier balancing member is positioned out of order there-above. Stable equilibrium will not be achieved and the stack will fall causing the child to try again until the balancing members are in proper order.

U.S. Pat. No. 5,932,303

An ornament shaped to be in balance about a surface point that is adapted to engage an upstanding projection. In one preferred embodiment, the ornament is formed from paper and is in the shape of a bird. The surface point is located at the bird's beak. The beak is adapted to engage the drinking edge of a vessel such as a glass. The center of mass of the bird is located below the surface point so that the bird has a stable equilibrium. The bird has a flat tail positioned to face upward. The tail may be written on, making the bird suitable for use a place indicator on a table at a formal function U.S. Pat. No. 6,612,895

A gyroscopic toy having a housing and an end post. The housing contains a spinning member, which can be caused to rotate about a first rotation axis of the housing for producing a gyroscopic effect while the end post rests on a surface to support the housing. A gimbals member is movably mounted on the exterior of the housing so that the first gimbals member can rotate about a second axis perpendicular to the first rotation axis. Two crescent-shaped members are movably mounted to the gimbals and one or two figurines are attached to the crescent-shaped members to enhance the visual effect. The toy comes with a support stand, the upper end of which has a concave surface to seat the end post. Alternatively, at least one foot of the figurine has a concave surface to seat the end post when the figurine is used as the support stand.

U.S. Pat. No. 6,773,328

A system comprising a rotating device and a finger supported charging assembly for powering the rotating device. The rotating device has a housing with a base upon which the housing spins. An electric motor is contained within the housing that causes the housing to spin when the motor is activated. The finger supported charging assembly includes two contacts that are coupled to opposite terminals of a battery pack. The contacts are worn on opposing fingers and come into contact with the rotating device when the base of the rotation device is supported with the opposing fingers, when contacting the rotating device, the contacts on the opposing fingers provide electricity to the rotating device that powers the motor within the rotating device.

However, these earlier efforts suffer from one or more of the following disadvantages, which decrease the utility and entertainment value of such efforts: they are limited in what objects may be angularly balanced, they do not allow for adjustment of the equilibrium balancing angle of an object affixed thereto without adjusting, changing, or combining counterweights, they do not utilize a pointed spike and concave depression arrangement between their balance members and supports, they do not utilize magnets to connect a balance member to an object and maintain the equilibrium balancing angle, they are not able to balance without spinning, and they do not allow an object to freely move about a point upon which it is supported.

BRIEF SUMMARY OF THE INVENTION

The present invention is directed to a balancing device that, in one or more aspects, supports a variety of objects at an equilibrium balancing angle that is adjustable without adjusting, changing, or combining counterweights, utilizes a magnetic attachment between a balance member and object to be balanced, utilizes a pointed spike and concave depression arrangement between a balance member affixed to the object and stand therefor, maintains an equilibrium balancing angle without requiring an object to be spun, and allows and object to freely spin about a point.

In accordance with a first embodiment, a balancing device is composed of a ferrous metal plate to be affixed to an object to be balanced, a balance member having a magnet to adjustably attach to the ferrous metal plate at one end and a pointed spike protruding from another end, and a support with a concave recess to receive and support the spike of the balance member. In addition, the ferrous metal plate of the first embodiment is clamped to the surface of the object and positioned so the plate is near a point vertically in line with the object's center of gravity. Also in accord with the first embodiment, the balance member has a cylindrical shaped body with a magnet at one end and pointed spike protruding from an opposite end. Further, with respect to the first embodiment, the support is an inverse funnel shape with a flat base to rest on a flat surface and tubular opposite end terminating in a concave recess at a point above the resting surface to receive and support the pointed spike.

In use, a user selects an object to be balanced, such as a plate, panel, board, or even bottle and affixes the ferrous metal plate to the surface thereof so the ferrous metal plate is preferably near a point vertically in line with the object's center of gravity. For example, the user may clamp the ferrous metal plate to a U-shaped board so the ferrous metal plate located at a point within the legs and base of the shape corresponding with its center of gravity. Once affixed, the user then magnetically attaches the balance member to a point on a surface of the ferrous metal plate and places the balance member and object upon the support so that the pointed spike rests within the concave recess thereof. Upon placement, the object will naturally come to rest at an equilibrium angle based on the location of the balance member with respect to the ferrous metal plate and the center of gravity of the object. A user can then adjust the equilibrium balancing angle, as desired, by altering the location of the balance member on the ferrous metal plate. In addition, the object may be freely rotated about the support. An object, so supported may thereby remain balanced on a particular point at a particular angle so long as the spoke and concave recess remains vertically in-line with the object's center of gravity.

Thereby, with a balancing device as described, a user may balance an object for entertainment and enjoyment purposes. For example, a user may choose to balance a game board, so placement of game pieces thereupon may provide an entertaining and challenging feature to the game. In an additional example, a user may choose to balance a bottle so that bottle may pivot and freely spin about a point and the motion of the bottle may provide entertainment—such as being utilized in the classic game of spin-the-bottle—or be utilized for pouring a substance contained therein in a novel and entertaining way.

BRIEF DESCRIPTION OF THE DRAWINGS

These and other features, aspects, and advantages of the present invention will become better understood with regard to the following description, appended claims, and accompanying drawings where:

REFERENCE NUMERALS

| | | | |
|---|---|---|---|
| 10 | Balancing Device | 12 | Plate |
| 14 | Clamp | 16 | Balance Member |
| 18 | Body | 20 | Magnet |
| 22 | Pointed Spike | 24 | Support |
| 26 | Flat Base | 28 | Concave Recess |
| 30 | Object | 32 | Center of Gravity |
| 40 | Threaded Plate | 42 | Threaded Pointed Spike |

DETAILED DESCRIPTION OF THE INVENTION

With reference now to the drawings, a new balancing device 10 and method of use for balancing an object at an adjustable equilibrium balancing angle without adjusting, changing, or combining counterweights are herein described.

First Embodiment of the Balancing Device

Figure 1:
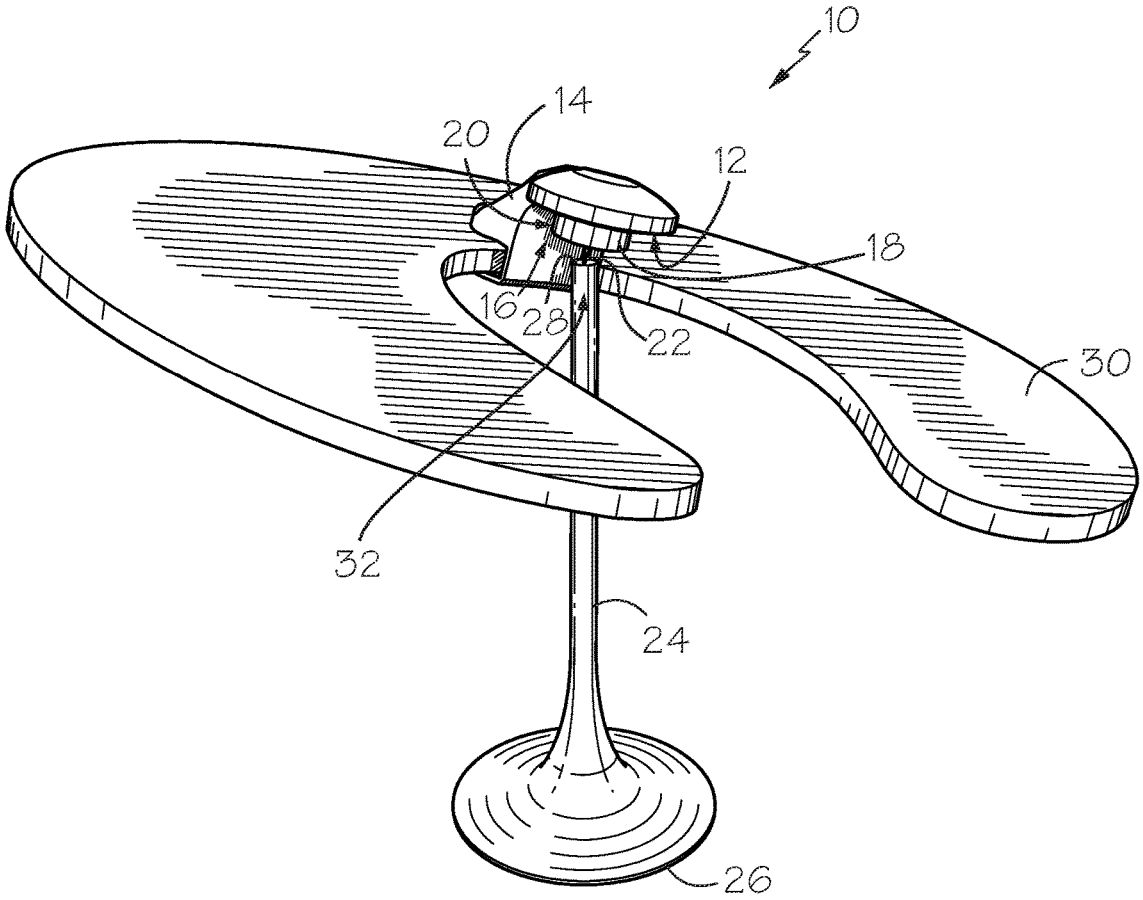
FIG. 1 is a perspective view of one embodiment of a balancing device balancing a U-shaped board at an angle including a ferrous metal plate affixed by clamp to the U-shaped board and attached to the magnet of a cylindrical shaped body member which has a protruding pointed spike inserted into and held up by a concave recess in an inverse funnel shaped support.

As in FIG. 1, the present invention includes in a first embodiment, a balancing device for balancing an object 30 having a ferrous metal plate 12 to be affixed to the object 30, a balance member 16 to magnetically and adjustably attach to the ferrous metal plate 12 and with a pointed spike 22 at an end thereof, and a support 24 which can rest on a surface and has a concave recess 28 to receive and support the pointed spike 22 of the balance member and thereby support the object 30. Further in accordance with the first embodiment, the balance member 16 magnetically and adjustably attaches to the ferrous metal plate 12 through a magnet 20 affixed to an end of a cylindrical shaped body 18 opposite the pointed spike 22. Also, in accordance with the first embodiment, the support 24 has an inverse funnel shape terminating at one end in a flat base 26 to rest on a flat surface and at another end in a smaller tubular end with a concave recess 28 which supports the balance member 16 and object 30 above the resting surface and facilitates a wide range of angular motion. Lastly in accordance with first embodiment, the ferrous metal plate 12 thereof is affixed to the object 30 through a clamp 14, as in FIG. 1, so that the ferrous metal plate 12 can be located near a point vertically in line with the object's center of gravity 32 even though such center of gravity 32 is located outside of the object 30, like with the U-shaped board.

First Embodiment of the Method of Use

In a first embodiment, a method of utilizing a balancing device 10 includes a user selecting an object 30 to be balanced. Objects 30 may include one of a number of articles, including—but not limited to—a shaped flat sheet, dish, or even a bottle. Once selected, a user may then affix the ferrous metal plate 12 to the object 30 so the ferrous metal plate 12 is disposed near a point vertically in line with the object's center of gravity 32. For example, if a user selected a U-shaped board 30—as in FIG. 1—the user may clamp 14 the ferrous metal plate 12 to the board 30 so that the plate 12 is located between the legs and base of the board 30, at a point corresponding to the center of gravity 32 of the board 30.

Once the ferrous metal plate 12 is affixed to the object 30, the user may then attach the balance member 16, through its magnet 20, to a point on the surface of the ferrous metal plate 12. Upon attaching the balance member 16, the user may then place the balance member 16, and object 30, on top of the support 24 so that the pointed spike 22 rests within the concave recess 28 thereof, just as in FIG. 1. After placing the object 30 and balance member 16 on the support 24, the user may then let the object 30 naturally come to rest at an equilibrium balancing angle based on the location of the balance member 16 with respect to the ferrous metal plate 12 and center of gravity 32 of the object 30. As desired, a user may then adjust the equilibrium balancing angle by shifting the location of the balance member 16 on the surface of the ferrous metal plate 12 and may also freely rotate the object 30 about the support 24. Also, an object 30 may thereby remain balanced on a particular point at a particular angle as long as the spike 22 and concave recess 28 remains vertically in-line with the center of gravity 32.

Variations—Balancing Device

Plate

Figure 3:
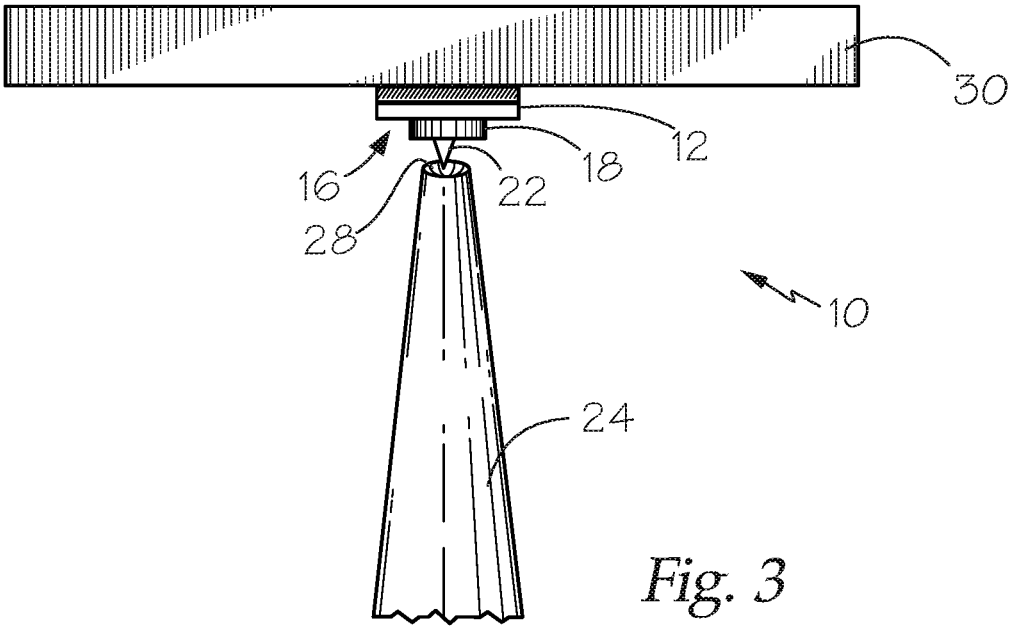
FIG. 3 is a side view of one embodiment of a balancing device balancing a bar shaped object where a plate is affixed by hook and loop fastener to a object at a point vertically in line with the center of gravity of the object.
Figure 4:
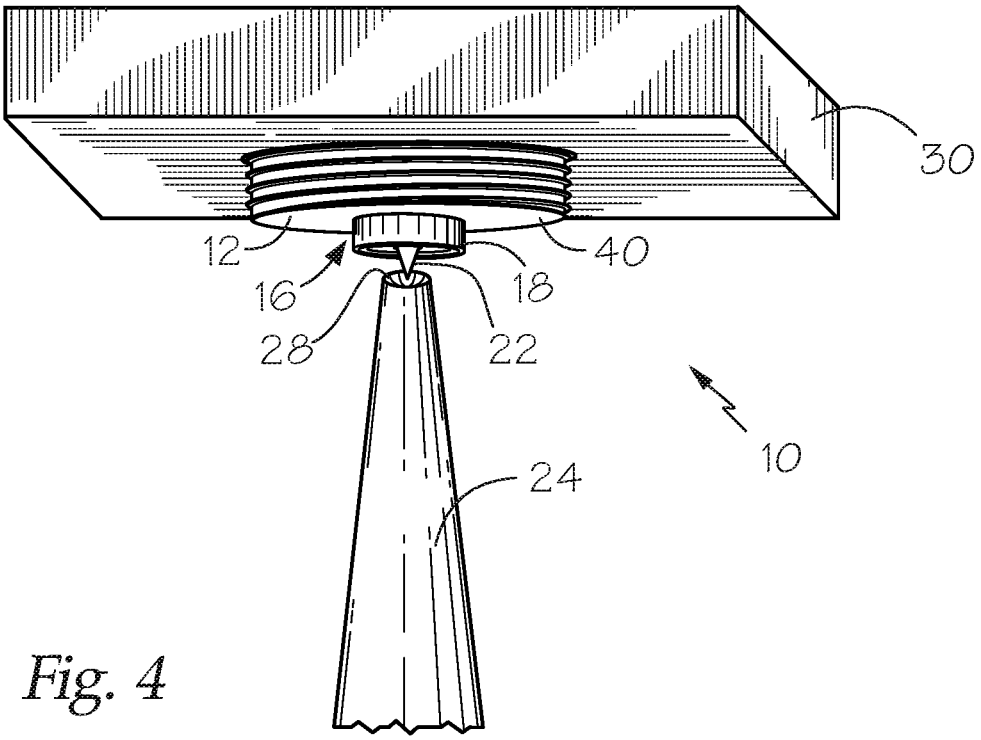
FIG. 4 is a perspective view of one embodiment of a balancing device balancing a rectangular block shaped object wherein a plate is threaded to screw into a recess in the object and thereby able to allow removal of the plate and adjustment of the distance between the object and the support.

While in the first embodiment, the ferrous metal plate 12 is affixed to the object 30 via a clamp 14, it is foreseen that in alternative embodiments the plate 12 may be affixed in a number of ways temporarily or permanently. For example, the plate 12 may be affixed through adhesives, fasteners (as in FIG. 3), or being integrally formed with the object 30. Further, in alternative embodiments, the plate 12 may also be affixed to an object 30 by being threaded to screw into a threaded recess in the object 30 directly, as in FIG. 4, or in an intermediary connecting element affixed to an object 30. Such a threaded plate 40 and recess may also, depending upon their dimensions, allow adjustment of the distance between the pointed spike 22 and object 30. In a further example, the plate 12 may be affixed to an object 30 by being shaped to receive such object 30, as in the plate 12 and bottle 30 of FIG. 7.

In further embodiments, the plate 12 may also allow for adjustment of the distance between the spike 22 and the object 30 by being affixed to an end of a threaded screw which is adjustably affixed to the object 30 directly or through an intermediary connecting element, such as a clamp 14. It is also foreseen that, in lieu of a threaded screw, alternative means for affixing the plate 12 to the object 30 which allows for the distance therebetween to be adjusted may be utilized. There are many means for providing such adjustment, and one skilled in the art will recognize that any suitable means for providing such adjustment may be employed.

Also, while the plate 12 of the first embodiment is described as being made of ferrous metal, it is foreseen that other types of plates may be utilized in the present device 10, as long as they allow for removable attachment of a balance member 16 thereto. For example, the plate 12 may comprise a hook and loop fastener (e.g. VELCRO®) layer or region along a surface to which the balance member 16 may be affixed.

Figure 7:
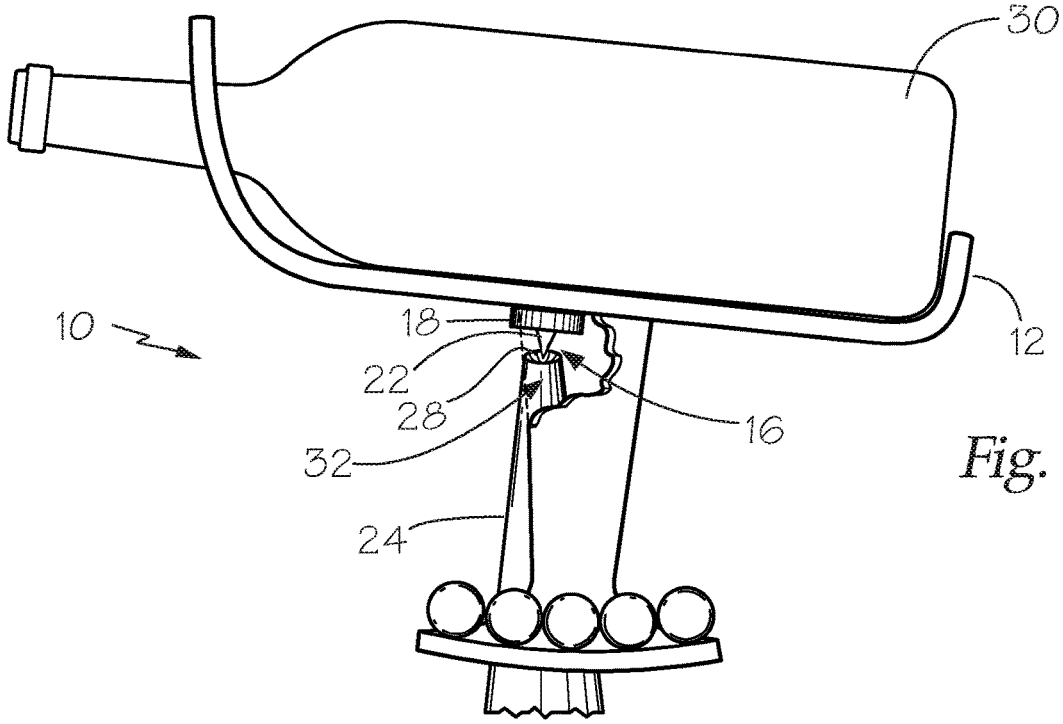
FIG. 7 is a side view of one embodiment of a balancing device balancing a bottle at an angle having a plate shaped to receive and support a bottle and where the angle the bottle is balanced at is influenced by where the balance member is attached along the plate with respect to the center of gravity of the bottle and plate.
Figure 8:
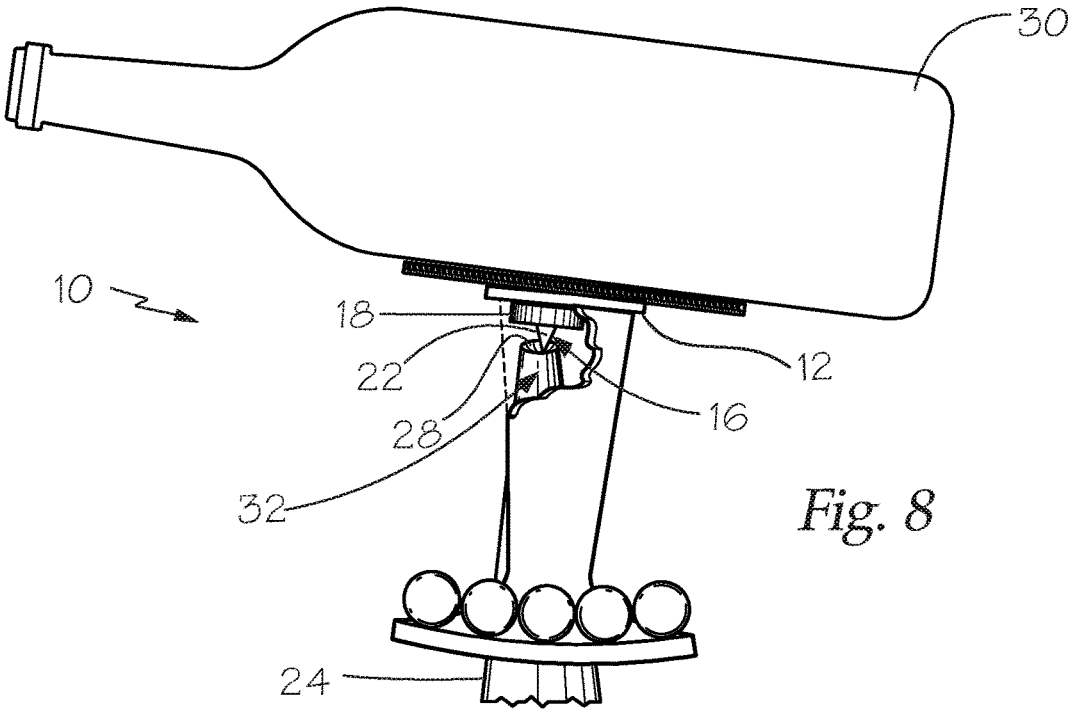
FIG. 8 is a side view of one embodiment of a balancing device balancing a bottle at an angle where the plate is removably affixed to the bottle through hook and loop fasteners and the angle the bottle is balanced at is influenced by where the plate, and thereby the balance member, is disposed on the bottle with respect to the center of gravity of the bottle and plate.

Furthermore, while the ferrous metal plate 12 of the first embodiment includes no specific counterweights, it is foreseen—as in FIGS. 7 and 8—that such counterweights may be attached to a plate 12 to adjust the location of the relevant center of gravity 32, thereby creating a more stable balancing arrangement. Since both the plate 12 and object 30 are balanced, the addition of counterweights to the plate 12 or the use of a plate 12 with integrated counterweights influences the center of gravity 32 by averaging it between both the counterweighted plate 12 and the object 30 instead of just the object 30. It is also foreseen that, in addition to or in lieu of the plate 12, counterweights may additionally be affixed to the object 30 itself, to also influence the relevant center of gravity 32.

Lastly, while FIGS. 2 and 4-6 show the plate 12 as a disk, it is foreseen that the plate 12 may be any suitable shape. For example, the plate 12 may be flat or tubular, with a square, rectangular, oval, circular, or other shape surface upon which the balance member 16 may be positioned.

Balance Member

While in the first embodiment, the balance member 16 has a cylindrical body 18, in alternative embodiments, it is also foreseen that the body 18 of the balance member 16 may be any desired shape. For example, the body 18 may be a square, rectangle, or prism shape. Further, it is also foreseen that the magnet 20 may be removably affixed to the body 18, thereby allowing substitution of different magnets 20, such as those of different strengths.

Also, while the balance member 16 is affixed to the plate 12 through a magnet 20 in the first embodiment, in alternative embodiments it is foreseen that the balance member 16 may be affixed to the plate 12 by other means, particularly if such plate 12 is not composed of ferrous metal. For example, the balance member 16 and plate 12 may be affixed together through hook and loop fasteners (such as VELCRO®), thereby allowing the balance member 16 to be adjustably affixed upon the plate 12. However, there are many other means for providing such adjustable attachment, and one skilled in the art will recognize that any suitable means for providing such attachment may be employed.

Figure 2:
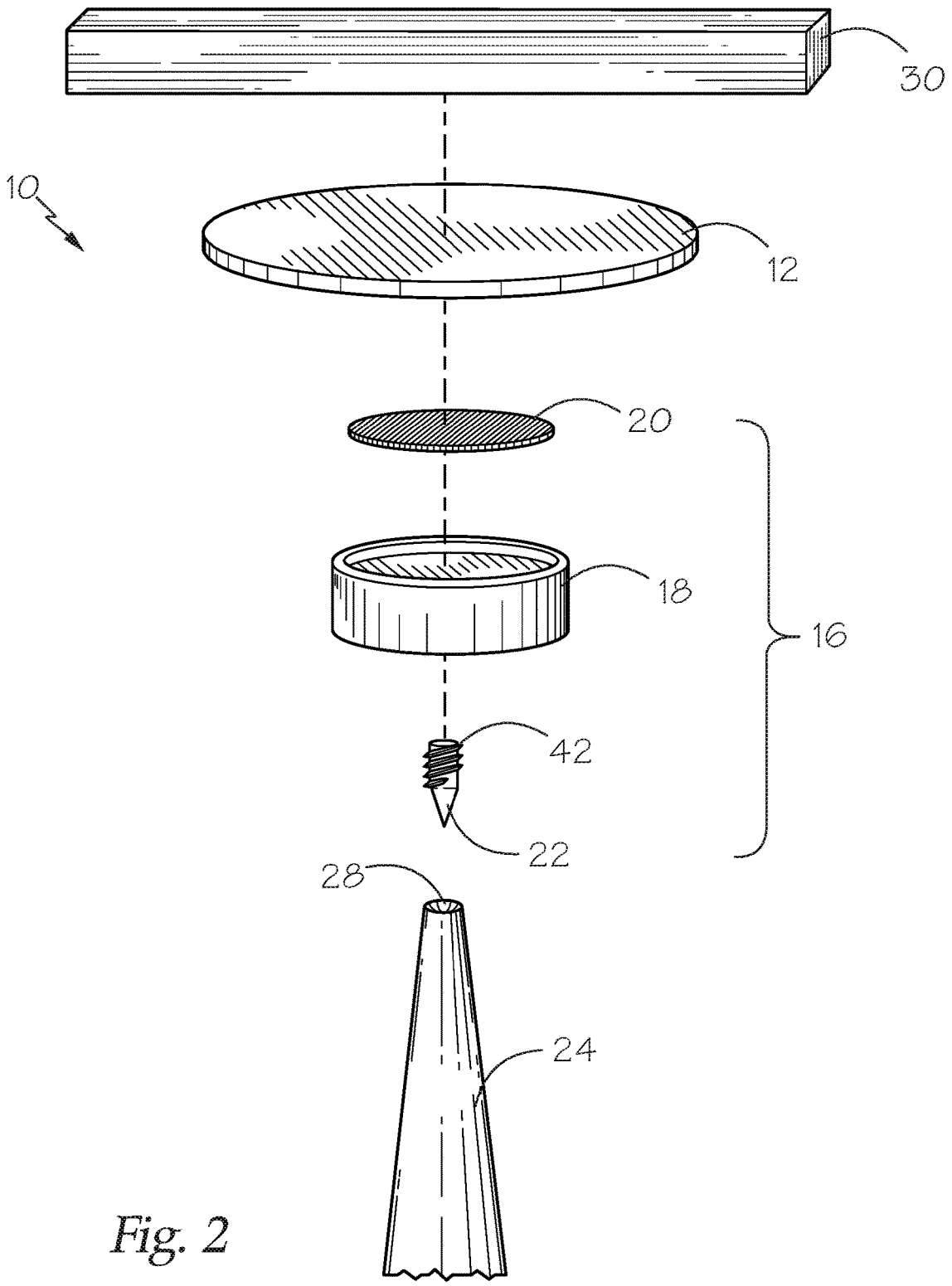
FIG. 2 is an exploded perspective view of one embodiment of a balancing device including a ferrous metal plate underneath and vertically in line with the center of gravity of a bar shaped object, a balance member with a magnet, a cylindrical shaped body and a removable pointed spike, and a support with a concave recess.
Figure 5:
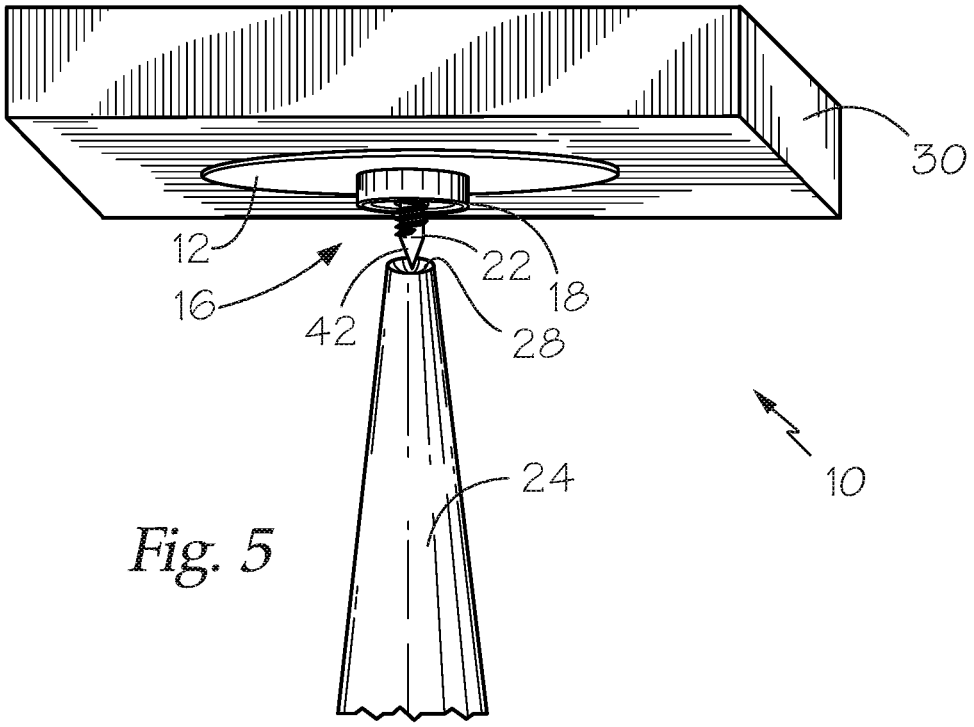
FIG. 5 is a perspective view of one embodiment of a balancing device balancing a rectangular block shaped object wherein the pointed spike of the balance member is threaded to screw into a recess in the body thereof and thereby able to allow removal of the pointed spike and adjustment of the distance between the object and the support.

Moreover, in particular embodiments, the pointed spike 22 may also be removable from the body 18. For example, the pointed spike 22 may be threaded to screw into a threaded recess in the body 18, as shown in FIGS. 2 and 5. Thereby, the threaded pointed spike 42 may be removed from the body 18 and, depending upon the dimensions of the pointed spike 42 and the recess in the body 18, may allow adjustment of the distance between the pointed spike 42 and the object 30 by being screwed in and out. Also, the pointed spike 22 may be removably affixed to the body 18 through hook and loop fasteners (such as VELCRO®). There are many other means for providing such removable attachment, and one skilled in the art will recognize that any suitable means for providing such attachment may be employed.

Lastly, while in the first embodiment, a user can manually adjust the position of the balance member 16 with respect to the plate 12, it is also foreseen that the balancing device 10 may also include an additional mechanism which can independently adjust the position of the balance member 16 automatically or in response to a user's demand. For example, the balance member 16 may include a controller device which can receive commands from a remote and adjust the position of the balance member 16 on the plate 12 in response to those commands. For example, such a controller device may include a wireless signal receiver connected to a battery and rotor or arm assembly which, upon reception of a wireless signal may move the rotor or arm to engage the plate 12 or balance member 16 itself to thereby adjust the balance member's position.

Support

Also, while in the first embodiment the support 24 is described as being an inverse funnel shape, it is foreseen that in alternative embodiments the support 24 may be any desired shape. For example, the support 24 may be tubular, rectangular, or square shaped. Further, in additional embodiments, it is also foreseen that the support 24 may be adjustable in length or width, to highlight the operation and enhance entertainment and enjoyment of the balancing device 10. While it is preferred that the support 24 be freely movable, it is also foreseen that the support 24 may be affixed or include means to be affixed to a surface in a temporary or permanent manner to enhance the stability of the support 24 and balancing device 10.

Spike/Concave Recess Arrangement

Figure 6:
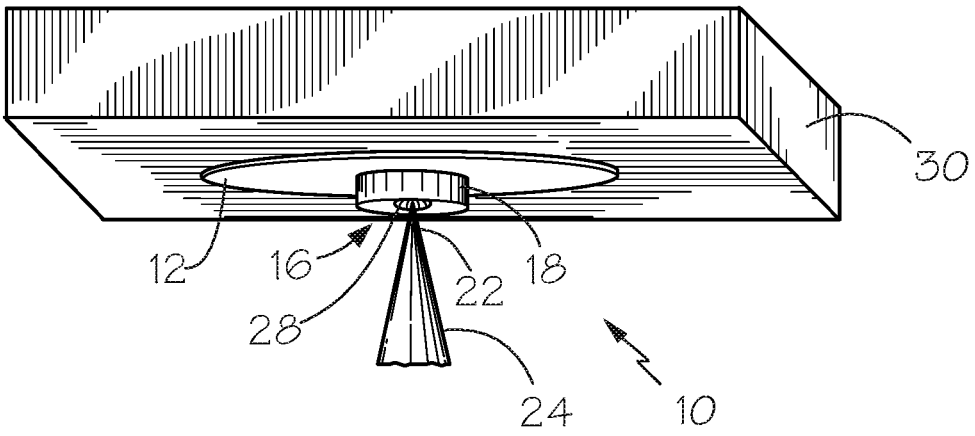
FIG. 6 is a perspective view of one embodiment of a balancing device balancing a rectangular block shaped object and including a support with a pointed spike which is inserted into the concave recess in the body of the balance member thereby supporting the balance member, plate, and object.

Further, while in the first embodiment the pointed spike 22 protrudes from the body 18 and rests in a concave recess 28 formed at an end of the support 24 (as in FIGS. 1 and 3-5), it is also foreseen that in an alternate embodiment, this arrangement may be amended so that the concave recess 28 is formed into the body 18 while an end of the support 24 may terminate in the pointed spike 22, as in FIG. 6. Thereby, the concave recess 28 and body 18 rests upon and is supported by the pointed spike 22.

Variations—Method of Use

Moreover, while the equilibrium balancing angle is adjusted in a first method of use by altering the location of the magnet 20 and the balance member 16 upon the surface of a plate 12 (as in FIG. 7), in alternative embodiments, a user may adjust the equilibrium balancing angle by altering where the plate 12 is affixed in relation to the center of gravity 32 of the object 30, as in FIG. 8. Such alteration may be done in place of or in addition to movement of the balance member 16 on a plate 12. Thereby, the range of the equilibrium balancing angle of an object 30 may be extended and the angle itself may be influenced without adjusting, changing, or combining counterweights.

Also, while the relevant center of gravity 32 in the first embodiment is that of the object 30 itself, it is foreseen that such center of gravity 32 may be influenced by an initial choice of counterweights. As in FIGS. 7 and 8, a user may select or be provided with a plate 12 that has counterweights attached specifically designed to create a stable balancing angle for a particular object 30. Alternatively, a user may select or be provided with counterweights that may be affixed directly to an object 30 which are similarly designed to create a stable balancing angle for a particular object 30. Thereby, use of the device 10 may include a user choosing a particular plate 12 having counterweights, counterweights to affix to an adaptable plate 12, or counterweights to affix directly to an object 30, to influence the center of gravity 32 and stability of the balancing arrangement.

In further alternative embodiments, a user may also adjust the distance of the pointed spike 22 with respect to the object 30 being balanced by extending or retracting the pointed spike 22 itself from the body 18 of the balance member 16 or the plate 12 from the object 30. Thereby, the magnitude of an adjustment of the equilibrium balance angle by movement of the balance member 16 on the surface of the plate 12 may be influenced and the range of the equilibrium balancing angle may be extended.

It is also foreseen that, in an embodiment, a user may adjust the height of the object 30 from a surface by adjusting the length of the support 24. Thereby, a user may highlight the operation and enhance the entertainment and enjoyment of the balancing device 10.

The term "comprises" and grammatical equivalents thereof are used herein to mean that other components, ingredients, steps. etc. are optionally present. For example, an article "comprising" (or "which comprises") components A. B, and C can consist of (i.e., contain only) components A. B, and C, or can contain not only components A, B. and C but also one or more other components.

Although the present invention has been described in considerable detail with possible reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features. Further, it is not necessary for all embodiments of the invention to have all the advantages of the invention or fulfill all the purposes of the invention.

In the present description, the claims below, and in the accompanying drawings, reference is made to particular features of the invention. It is to be understood that the disclosure of the invention in this specification includes all possible combinations of such particular features. For example, where a particular feature is disclosed in the context of a claim, that feature can also be employed, to the extent possible, in aspects and embodiments of the invention, and in the invention generally.

Also, although the description above contains many specificities, these should not be construed as limiting the scope of the embodiments but as merely providing illustrations of some of several embodiments. Thus, the scope of the embodiments should be determined by the appended claims and their legal equivalents, rather than by the examples given.

What is claimed is:

1. A balancing device comprising:

a plate comprising opposed flat front and rear surfaces and at least one edge along a perimeter there-between, wherein said rear surface may be affixed to an object to be balanced;

a balance member including a body, wherein a first end of said body is adapted to removably attach to said front surface of said plate so said balance member can be moved along said front surface of said plate to influence the angle at which said object is balanced; and a support, wherein a second end of said body and one end of said support each have one of a pointed spike and a concave recess to receive said pointed spike.

2. The balancing device of claim 1, wherein said plate is affixed by a clamp to said object to be balanced.

3. The balancing device of claim 1, wherein said plate is affixed to said object through one selected frons the group of adhesives, fasteners, and being integrally formed with said object.

4. The balancing device of claim 1, wherein said plate is affixed to said object at a point near a vertical tine passing through the center of gravity of said object.

5. The balancing device of claim 1, wherein said pointed spike is removable.

6. The balancing device of claim wherein the length of said pointed spike is adjustable.

7. The balancing d of claim 1, wherein the distance of a surface of said plate from said object is adjustable.

8. The balancing device of claim 1, wherein said plate is composed of ferrous metal and said balance member includes a magnet affixed to said first end of said body so said balance member ca be removably attached to said plate.

9. The balancing device of claim 8, wherein said ma net is removably affixed to said body.

10. A method for utilizing a balancing device comprising:

providing a balancing device including a plate comprising opposed flat front and rear surfaces and at least one edge along a perimeter there-between, a balance member adapted to removably attach to said front surface of said plate so said balance member may be moved along said front surface, and a support, wherein said support and said balance member each have one of a first pointed spike and a concave recess;

selecting an object to be balanced;

affixing said rear surface of said plate to said object;

attaching said balance member to said front surface of said plate;

placing said object and balance member upon said support so said first pointed spike is inserted into said concave recess; and allowing said object to be supported at a balancing angle.

11. The method of claim 10, further including adjusting said balancing angle by moving where said balance member is attached to said plate.

12. The method of claim 10, further including adjusting said balancing angle by moving where said plate is affixed to said object.

13. The method of claim 10, wherein said plate is affixed to said object at a point near a vertical line passing through the center of gravity of said object.

14. The method of claim 10, further including adjusting the length of said first pointed spike.

15. The method of claim 10, further including adjusting the distance of said plate from said object.

16. The method of claim 10, further including replacing aid first pointed spike with a second pointed spike.

17. The in method of claim 10, wherein said plate is affixed to said object through a clamp.

18. The method of claim 10, wherein said plate is affixed to said object through one selected from the group of adhesives and fasteners.

19. The method of claim 10, wherein said plate is composed of ferrous metal and said balance member includes a first magnet to removably attach to said plate.

20. The method of claim 10, were said balance member is attached to said plate through a fastener.

* * * * *